United States Patent [19]

Uematsu et al.

[11] Patent Number: 4,786,300

[45] **Date of Patent: * Nov. 22, 1988**

[54] AIR CONDITIONER

[75] Inventors: Masao Uematsu, Fujinomiya; Yasuo Asakura, Shizuoka, both of Japan

[73] Assignee: Kabushiki Kaisha Toshiba, Kawasaki, Japan

[ * ] Notice: The portion of the term of this patent subsequent to Feb. 22, 2003 has been disclaimed.

[21] Appl. No.: 632,654

[22] Filed: Jul. 20, 1984

[30] Foreign Application Priority Data

Jul. 20, 1983 [JP] Japan ..... 58-132626

[51] Int. Cl.[4] ..... F25D 23/12

[52] U.S. Cl. ..... 62/259.1

[58] Field of Search ..... 62/324.1, 259.1; 165/48 R, 59, 60

[56] References Cited

U.S. PATENT DOCUMENTS 2,708,568 5/1955 Marshall ..... 62/259.1
2,896,428 7/1959 Paton ..... 165/48 R
4,203,302 5/1980 Lapeyre ..... 62/259.1

FOREIGN PATENT DOCUMENTS 55-36747 8/1980 Japan .
1587520 4/1981 United Kingdom .

*Primary Examiner*—Henry A. Bennet
*Attorney, Agent, or Firm*—Cushman, Darby & Cushman

[57] ABSTRACT

An air conditioner is installed in the respective floors of a building and has a housing built in a space between the ceiling of one story and the floor of another story lying above the story. The housing is provided with a first suction port and a first ejection port which communicate with the upper story through the floor, and a second suction port and a second ejection port which communicate with the lower story through the ceiling. A condensation heat exchanger and an evaporation heat exchanger are arranged in the housing. A first blower is arranged in the housing to conduct the air of the upper story into the housing through the first suction port and discharge the air into the upper story through the heat exchanger and first ejection port. A second blower is arranged in the housing to conduct the air of the lower story into the housing through the second suction port and discharge the air into the lower story through the heat exchanger and second ejection port. Valves are arranged in the ports to selectively open the ports.

8 Claims, 7 Drawing Sheets

AIR CONDITIONER

BACKGROUND OF THE INVENTION

This invention relates to an air conditioner and, particularly, to an air conditioner set in the respective floors of a building having more than two stories.

The most widely accepted large-scale commercial air conditioner constructed, for example, in a building is generally of the type which is suspended from the ceiling or built therein in order to reduce the installation space as much as possible. With such types of air conditioners, an air ejection port is positioned on the ceiling or in its vicinity. Therefore, the conventional air conditioner has the drawback that though the indoor temperature distribution can be rendered substantially uniform during the cooling mode, warmth is undesirably collected in the vicinity of the ceiling, thereby preventing the temperature in the near the floor from being sufficiently raised. Therefore, during the heating mode, hot air streams are ejected downward, or at a higher flowing speed, in order to ensure the effective approach of hot air streams to the vicinity of the floor. In such a case, however, hot air streams directly touch the occupants of the room, resulting in discomfort.

SUMMARY OF THE INVENTION

This invention has been accomplished in view of the above-mentioned circumstances and is intended to provide an air conditioner which ensures a proper indoor temperature distribution during the heating as well as the cooling mode.

To attain the above-mentioned object, this invention provides an air conditioner which comprises:

a housing built between the upper and lower floors defining the respective story of a multi-storied building, the housing being provided with first suction and ejection ports communicating with the upper floor through the floor and second suction and ejection ports communicating with the lower floor through the ceiling;

a refrigeration cycle system equipped with a condensation heat exchanger and an evaporation heat exchanger which are built in the housing;

a first blower which is positioned near the condensation heat exchanger and conducts the air in the upper floor into the housing through the first suction port, and draws off cooled air streams on the upper floor from the first ejection port through the condensation heat exchanger;

a second blower, which is set near the evaporation heat exchanger in the housing, carries air streams on the lower floor into the housing through the second suction port, and ejects hot air streams into the lower floor from the second ejection port through the evaporation heat exchanger; and valve means which are fitted to the first suction and ejection ports and the second suction and ejection ports to open or close said ports as the need arises.

With an air conditioner embodying this invention, heated air streams are blown into the room from the floor through the first ejection port during the heating mode. During the cooling mode, cooled air streams are blown into the room from the ceiling through the second ejection port. Therefore, warm or cool air streams are uniformly distributed through the room, thereby ensuring a good temperature distribution through the room during the heating as well as the cooling mode.

BRIEF DESCRIPTION OF THE DRAWINGS

FIGS. 1 to 5 illustrate an air conditioner embodying this invention: FIG. 1 is a cross sectional view of the same; FIG. 2 is a schematic side view of the same; and FIGS. 3A, 3B, 3C, 4A, 4B, 4C and 5 schematically indicate the cross section of the same during the different modes thereof.

DETAILED DESCRIPTION OF THE PREFERRED EMBODIMENT

A description may now be made with reference to the accompanying drawings of an air conditioner embodying this invention.

Figure 1:
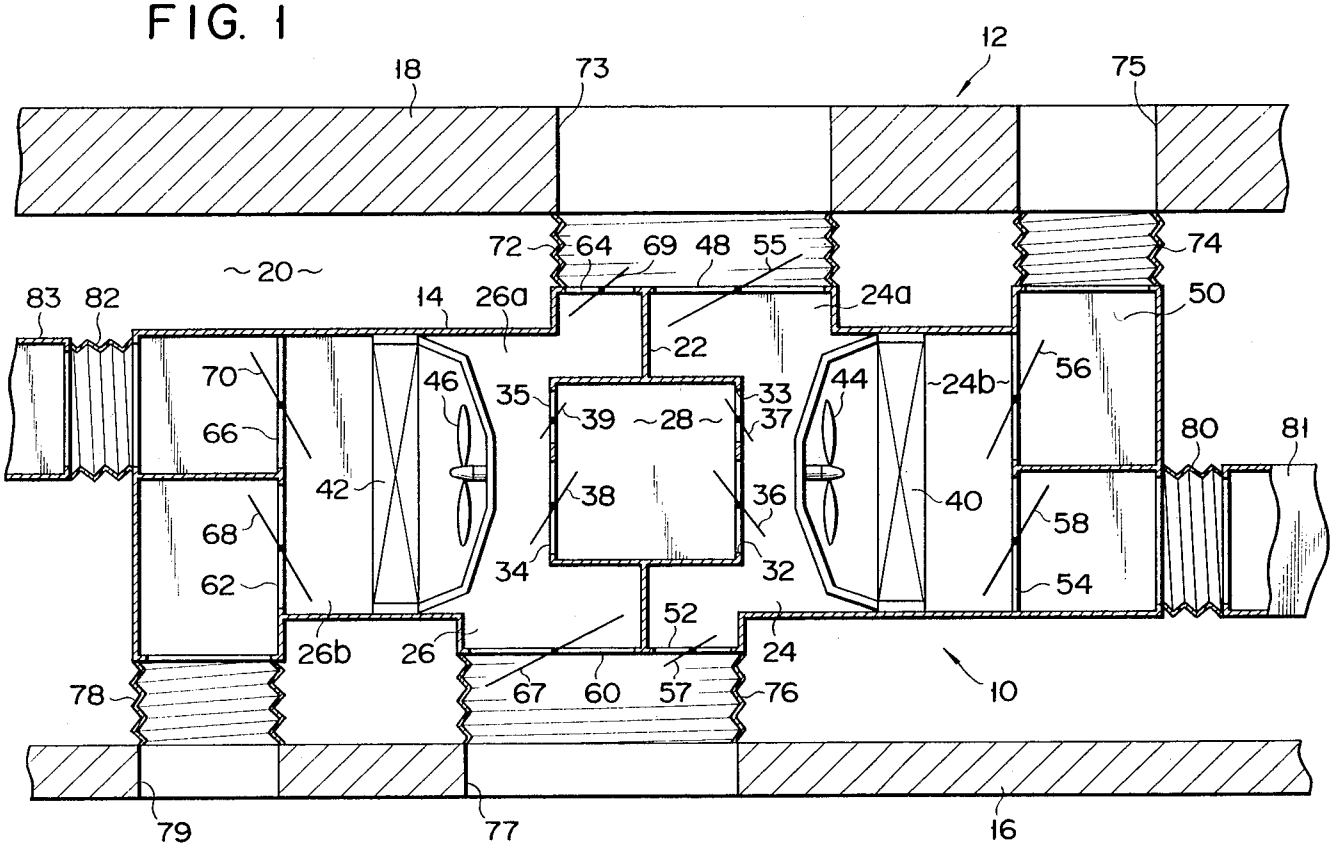
Figure 2:
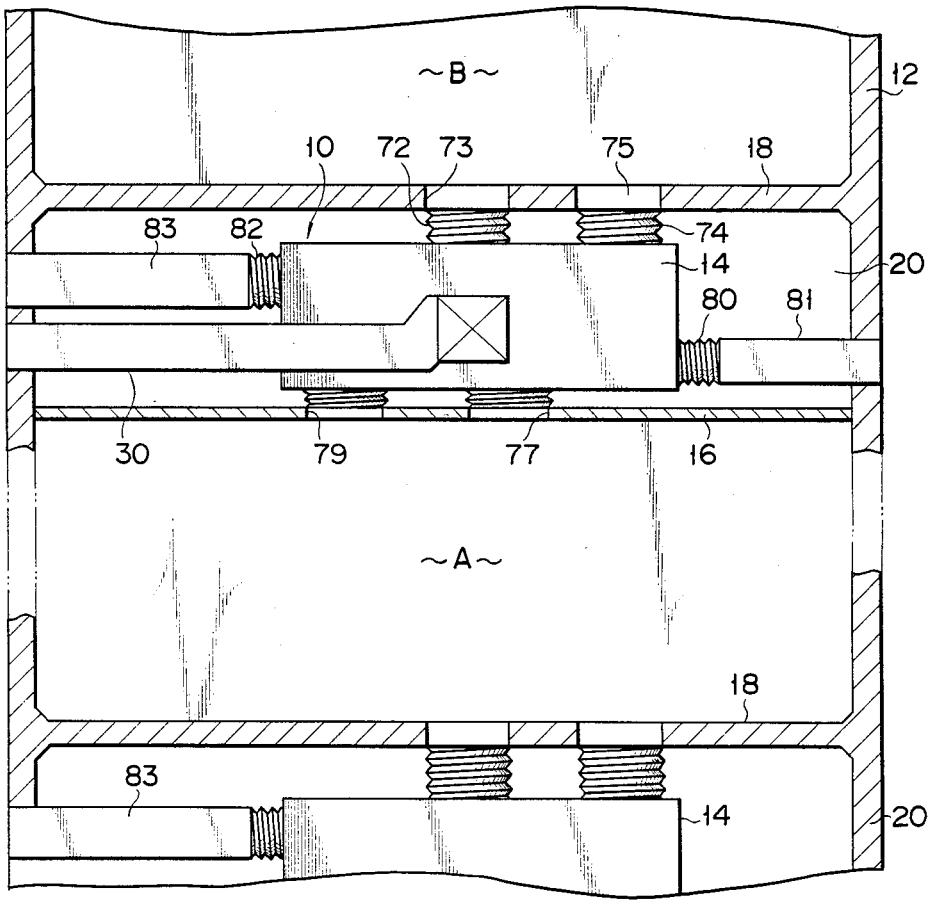

FIGS. 1 and 2 set forth an air conditioner 10 built in the respective floor of a building 12 having a plurality of stores. The air conditioner 10 is provided with a housing 14, which is built in a space 20 defined between the respective partition walls of the building 12, that is, a ceiling 16 of, for example, a floor A and a floor wall 18 of a floor B. The interior of the housing 14 is divided into a heating chamber 24 and a cooling chamber 26 by a partition wall 22. An open air introducing passage 28 is defined between the heating chamber 24 and cooling chamber 26 by the partition wall 22. The passage 28 communicates with the outdoor space through an air duct 30 fixed to the housing 14 at one end and open to the lateral wall of the building 12 at the other end. Formed in the partition wall 22 are a first main inlet port 32 and a first ventilation inlet port 33 which communicate with the passage 28 and heating chamber 24, and a second main inlet port 34 and a second ventilation inlet port 35 which communicate with the passage 28 and cooling chamber 26. These inlet ports 32 to 35 are provided with the corresponding flow-rate adjusting valves 36 to 39 to selectively close and open the inlet ports 32 to 35.

In the heating chamber 24 of the housing 14, a condensation heat exchanger 40 is set opposite to the inlet port 32. In the cooling chamber 26, an evaporation heat exchanger 42 is set opposite to the inlet port 34. The heat exchanger 40 divides the heating chamber 24 into an upstream heating chamber **24*a*, set beside the open air introducing passage 28, and a downstream heating chamber 24*b*. The heat exchanger 42 divides the cooling chamber 26 into an upstream cooling chamber 26*a*, set beside the passage 28, and a downstream cooling chamber 26*b*. The heat exchangers 40, 42 are connected through pipes (not shown) to a compressor and throttling device (neither shown), thereby constituting a refrigeration cycle system. In the upstream heating chamber 24*a*, a first blower 44 is set opposite to the condensation heat exchanger 40. In the upstream cooling chamber 26*a*, a second blower 46 is set opposite to the evaporation heat exchanger 42**.

The upper wall of the housing 14, that is the wall near the floor wall 18, is provided with a first suction port 48, open to the upstream heating chamber **24*a*, and a first ejection port 50, open to the downstream heating chamber 24*b*. A first ventilation port 52, open to the upstream heating chamber 24*a*, is formed in the lower wall of the housing 14, that is the wall located near the ceiling 16. A first open air outlet port 54, open to the downstream heating chamber 24*b*, is provided on the right side of the housing 14. These ports 48, 50, 52, 54 are provided with the corresponding flow-rate adjusting valves 55 to 58 to selectively open and close the ports 48 to 54**.

Provided in the lower wall of the housing 14 are a second suction port 60, open to the upstream cooling chamber 26*a*, and a second ejection port 62, open to the downstream cooling chamber 26*b*. A second ventilation port 64, open to the upstream cooling chamber 26*a*, is provided in the upper part of the housing 14. A second open air outlet port 66, open to the downstream cooling chamber 26*b*, is provided on the left side of the housing 14. These ports 60, 62, 64, 66 are fitted with the corresponding flow-rate adjusting valves 67 to 70.

The first suction port 48 and second ventilation port 64 communicate with the inside space of the floor B through a connection tube 72 and a first ventilation opening 73 formed in the floor 18. The first ejection port 50 communicates with the inside space in the floor B through a connection tube 74 and a second ventilation opening 75 formed in the floor 18. The second suction port 60 and first ventilation port 52 communicate with the floor A chamber through a connection tube 76 and a third ventilation opening 77 formed in the ceiling 16. The second ejection port 62 communicates with the floor A chamber through a connection tube 78 and a fourth ventilation opening 79 formed in the ceiling 16. The first open air outlet port 54 communicates with the outdoor space through a connection tube 80 and an exhaust duct 81. The second open air outlet port 66 communicates with the outdoor space through a connection tube 82 and an exhaust duct 83.

Figure 3A:
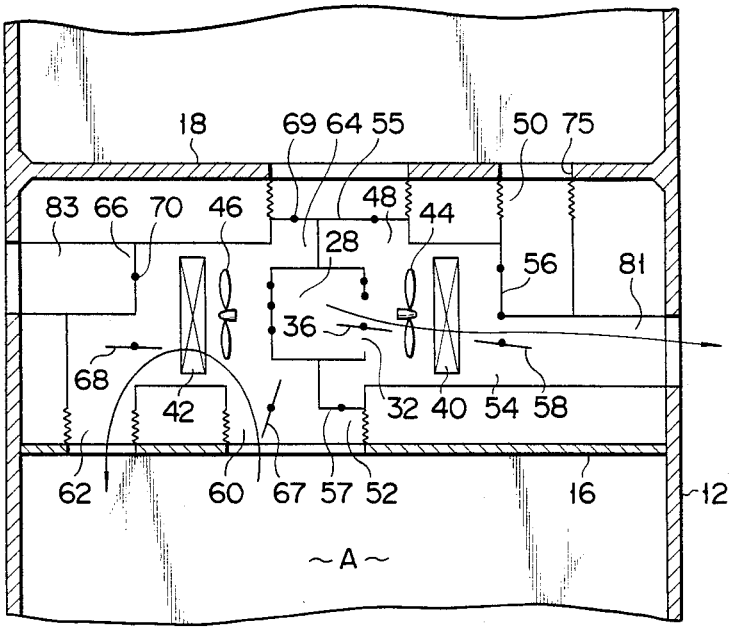
Figure 3B:
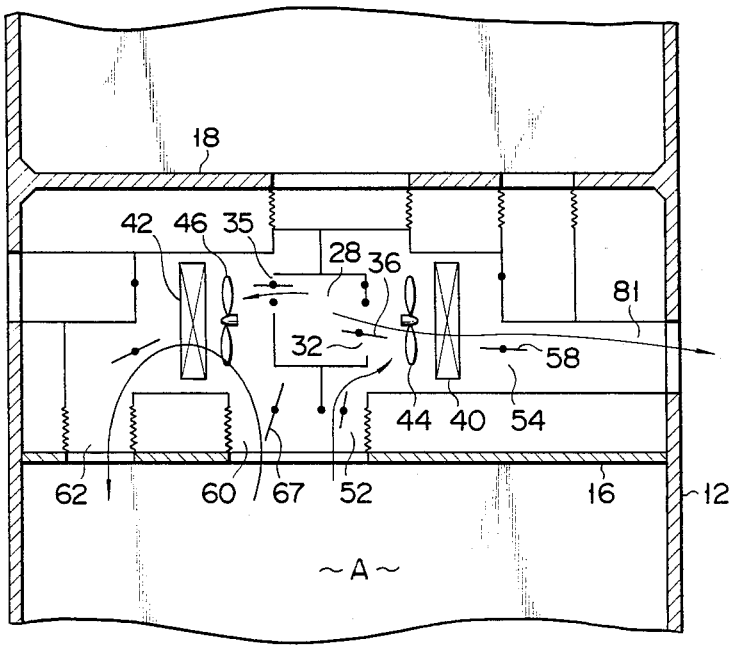
Figure 3C:
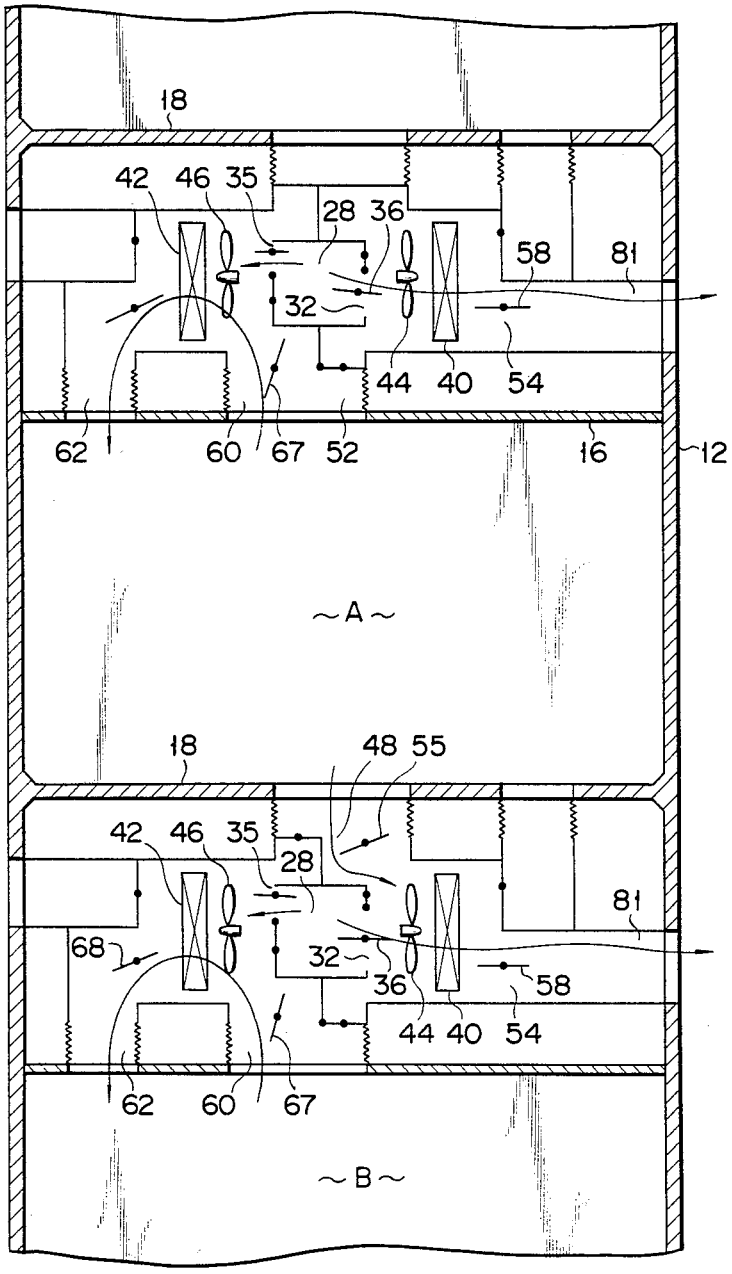

The operation of the air conditioner 10 constructed as mentioned above will be described with reference to FIGS. 3A, 3B, 3C, 4A, 4B, 4C and 5. FIGS. 3A, 3B and 3C respectively represent the cooling of a chamber A: the cooling and ventilation (1) of the chamber A and the cooling and ventilation (2) of the chamber A. During these operation modes, the flow-rate adjusting valves are set in the conditions shown in the table below (where a notation O represents the opening of the valves, a notation X denotes the close of the valves, and a notation Δ shows the partly opening of the valves.)

TABLE

| Operation mode of the air conditioner | Condition of the flow-rate adjusting valves | | | | | | | | | | | |
|---|---|---|---|---|---|---|---|---|---|---|---|---|
| | Valve | | | | | | | | | | | |
| | 36 | 37 | 38 | 39 | 55 | 56 | 57 | 58 | 67 | 68 | 69 | 70 |
| Cooling (normal) | O | X | X | X | X | X | X | O | O | O | X | X |
| Cooling + ventilation (1) | O | X | X | O | X | X | O | O | O | O | X | X |
| Cooling + Ventilation (2) | O | X | X | O | Δ | X | X | O | O | O | X | X |
| Heating (normal) | X | X | O | X | O | O | X | X | X | X | X | O |
| Heating + Ventilation (1) | X | O | O | X | O | O | X | X | X | X | O | O |
| Heating + Ventilation (2) | X | O | O | X | O | O | X | X | Δ | X | X | O |
| Cooling by open air | X | X | O | X | Δ | X | O | O | X | O | X | X |

COOLING OF CHAMBER A

Initially, the first and second blowers 44, 46 and refrigeration cycle system are put into operation. At this time, open air is conducted into the upstream heating chamber 24*a* through the air duct 30, open air introducing passage 28 and main inlet port 32. After being subjected to heat exchange in the condensation heat exchanger 40, the open air is discharged to outdoors through the first outlet port 54 and exhaust duct 81. Air in the chamber A flows into the upstream cooling chamber 26*a* through the ventilation opening 77 and second suction port 60. After being cooled in the evaporation heat exchanger 42, the air is brought into the downstream cooling chamber 26*b* and, thereafter, blown into the chamber A through the second ejection port 62 and ventilation opening 79, thereby cooling the chamber A.

Cooling of Chamber A+Ventilation (1)

Air streams for condensation and room cooling flow in the same manner as in the cooling of chamber A. Therefore, a description is only made of the flow of ventilation air streams. Ventilation open air is brought into the upstream cooling chamber 26*a* through the open air introducing passage 28 and second ventilation inlet port 35 and cooled in the heat exchanger 42. The cooled air is blown into the chamber A through the downstream cooling chamber 26*b*, second ejection port 62, and ventilation opening 79. Part of the air in the chamber A runs into the upstream heating chamber 24*a* through the ventilation opening 77 and first ventilation port 62, and is drawn outdoors together with condensation open air through the heat exchanger 40, exhaust port 54 and exhaust duct 81. Thus, the cooling and ventilation of the chamber A are effected. In this case, ventilation is carried out by introducing open air into the room wherein air conditioning is to be performed, and discharging part of the air retained in said room to the outside.

Cooling of Chamber A+Ventilation (2)

Air streams for condensation and room cooling run in the same manner as in the cooling of the chamber A. Therefore, a description is only made of the flow of the ventilation air streams. Ventilation open air is brought into the upstream cooling chamber 26*a* through the passage 28 and second ventilation inlet port 35, and is cooled in the heat exchanger 42. The cooled air is ejected into the chamber A through the second ejection port 62 and ventilation opening 79. Air in the chamber A is drawn off by another air conditioner installed in the ceiling of a chamber B, lying underneath the chamber A. The air in the chamber A flows into the upstream heating chamber 24*a* of another air conditioner through a ventilation opening formed in the floor of chamber A. Thereafter, the air is drawn outdoors through the heat exchanger 40, first exhaust port 54, and exhaust duct 81. At this time, the flow-rate adjusting valve 55, selectively operating the first suction port 48 of said another air conditioner, is opened to such an extent as enables the same amount of air of the chamber A as the fresh air taken into chamber A to be discharged outdoors.

In the above-mentioned case of ventilation, open air is introduced into the room where air conditioning should be performed by the air conditioner built in the ceiling of said room. The withdrawal of air from the room is carried out by another air conditioner installed in the floor of said room.

Figure 4A:
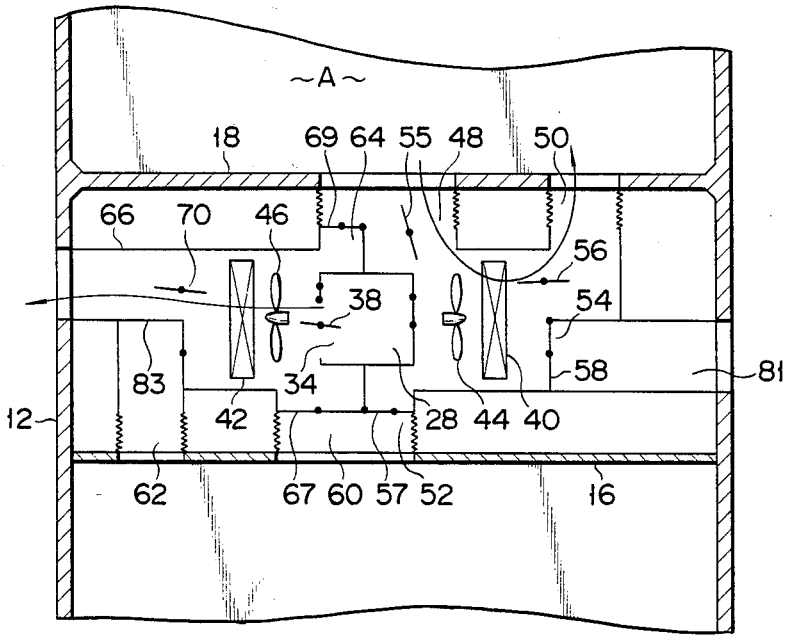
Figure 4B:
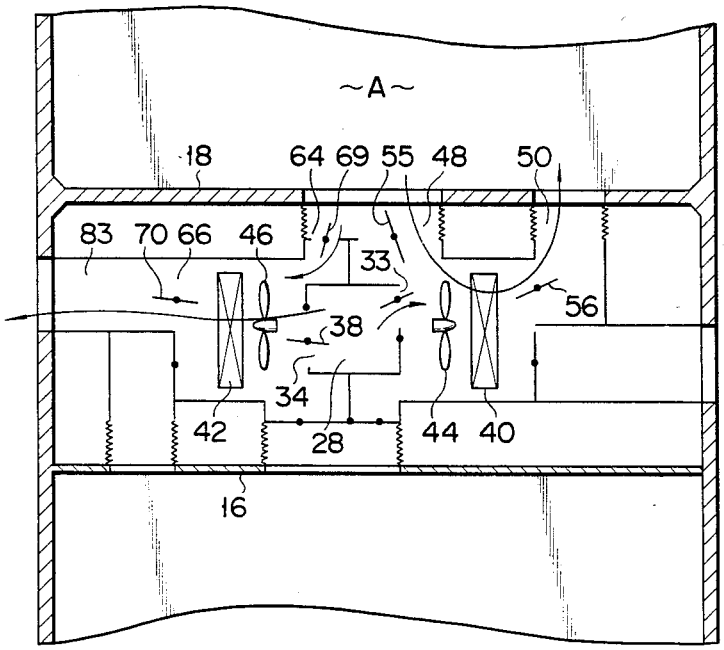
Figure 4C:
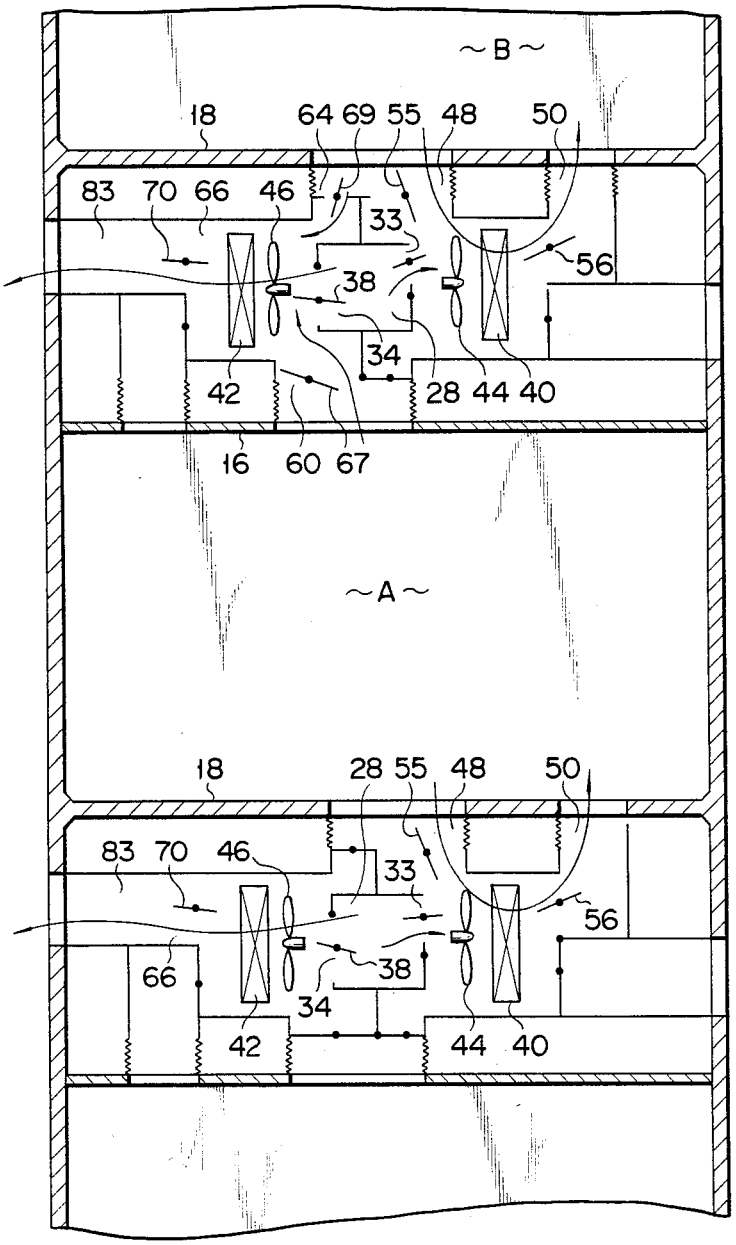

FIGS. 4A, 4B and 4C respectively show the heating of a chamber A, the heating and ventilating of the chamber A and the heating and ventilating of the chamber A. A description may now be mode of the above-mentioned various modes with reference to FIGS. 4A, 4B and 4C.

Heating of Chamber A

The first and second blowers 44, 46 and refrigeration cycle system are put into operation. All the flow-rate adjusting valves are set as shown in FIG. 4A. Open air for evaporation runs into the upstream cooling chamber 26*a* through the air duct 30, open air introducing passage 28 and second main open air inlet port 34. The open air undergoes heat exchange in the evaporation heat exchanger 42 and is drawn outdoors through the second exhaust port 66 and exhaust duct 83. Heating air flows from the chamber A through the first suction port 48 into the upstream heating chamber 24*a*. After heated in the heat exchanger 40, the air is brought into the downstream heating chamber 24*b* and blown into the chamber A through the first ejection port 50 and ventilation opening 75, thereby heating the chamber A.

Heating and Ventilation (1) of Chamber A

Open air for evaporation and heating air run in the same manner as in the heating of chamber A. Therefore, a description is only made of the flow of ventilation air. Ventilation open air enters the upstream heating chamber 24*a* through the open air introducing passage 28 and first ventilation inlet port 33. After heated in the heat exchanger 40, the open air is blown into a chamber A through the first ejection port 50 and ventilation opening 75. Part of the air in the chamber A enters the upstream cooling chamber 26*a* through the ventilation opening 73 and second ventilation port 64, and is drawn outdoors together with the evaporation open air through the heat exchanger 42 and exhaust duct 83. Thus, the heating and ventilation of the chamber A are carried out. Ventilation in the above-mentioned case is effected by introducing open air into the room where air conditioning should be performed and discharging part of the air in said room.

Heating and Ventilation (2) of Chamber A

Evaporation air and heating air flow in the same manner as in the case of heating chamber A. Therefore, a description is only made of the flow of ventilation air. Ventilation open air is carried into the upstream heating chamber 24*a* through the passage 28 and first ventilation inlet port 33. After heated in the heat exchanger 40, the ventilation open air is blown into a chamber A through the first ejection port 50 and ventilation opening 75. The ventilation of the chamber A is carried out by another air conditioner built in the floor of a chamber B, lying above the chamber A. The air of the chamber A flows into the upstream cooling chamber 26*a* through the ventilation opening 77 formed in the coiling of the chamber A and the suction port 60 of said another air conditioner and, thereafter, is drawn outdoors through the heat exchanger 42 and exhaust duct 83. At this time, the flow-rate adjusting valve 67, selectively operating the suction port 60 of said other air conditioner, is opened to such an extent as enables the same amount of air in the chamber A to be drawn outdoors as the fresh air take thereinto from the outside.

In the above-mentioned ventilation case, open air is introduced through the air conditioner built in the floor of the room where air conditioning should be performed. The discharge of air in said room is carried out by the air conditioner built in the ceiling of said room.

Figure 5:
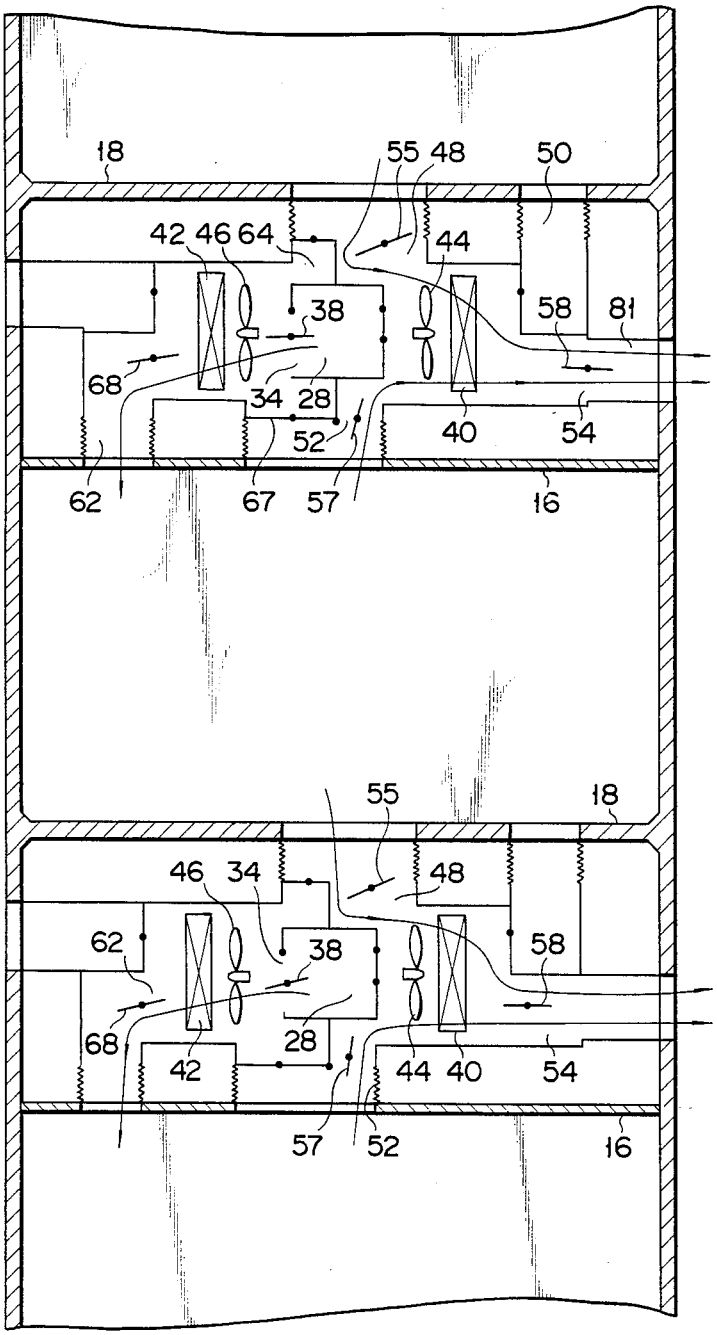

A description may now be made with reference to FIG. 5 of the other operation mode of the subject air conditioner. Namely, FIG. 5 represents its operation mode of cooling the room by utilizing open air of a relatively low temperature during the intermediate season of the year, for example, spring or autumn. The flow-rate adjusting valves 38, 55, 57, 58, 68 are operated to open the second open air inlet part 34, first suction port 48, first ventilation port 52, exhaust port 54 and second ejection port 62. At this time, the refrigeration cycle system remains inoperative, but the first and second blowers 44 and 46 alone are put into operation. Thus, open air flows into the upstream cooling chamber 26*a* through the air duct 30, open air introducing passage 28, and second open air inlet port 34. The open air is then blown into the room through the heat exchanger 42, second ejection port 62 and ventilation opening 79. As a result, the room is cooled by open air. Further, the air of the respective rooms is sucked into the upstream heating chamber 24*a* through the first ventilation port 52 provided in the ceiling side and the first suction port 48 provided in the floor side. After passing through the heat exchanger 40, the air is drawn outdoors through the exhaust port 54 and exhaust duct 81. Thus ventilation of each room is performed.

An air conditioner constructed as described above enables cool air to be ejected into the room from the ceiling during the cooling mode and hot air to be blown into the room through the floor during the heating mode. As a result, cool or warm air is not undesirably retained on the floor or ceiling, but is smoothly spread through the room, thereby ensuring a uniform temperature distribution in the room. The air conditioner which is built in a space defined between the ceiling and floor needs no special installation space in the room.

The subject air conditioner offers further advantages in that when the cooling and ventilating (1) of room, and the heating and ventilating (2) of room are performed, the air from the room is drawn outdoors through a heat exchanger, thereby making it possible to recover the heat of the air while it passes through the heat exchanger, namely enabling a coolant flowing through the heat exchanger to be heated or cooled by the above-mentioned air being conducted through the heat exchanger. In the case of the cooling and ventilating (2) of room, it is possible to discharge outdoors the air lying near the room floor whose temperature has fallen to a lower level than required. Moreover, in the case of the heating and ventilating (2) of room, it is possible to discharge outdoors the air lying near the ceiling whose temperature has risen to an upper level than required. Therefore, it is also possible to ensure a better temperature distribution in the room and the heat of the discharged air can be recovered very efficiently.

What is claimed is:

1. An air conditioner for installation in a building having a plurality of stories comprising:

a housing which is adapted to be built in a space defined between the ceiling of a first lower story and the floor of a second upper story lying above said first story, and is provided with a first suction port and a first ejection port both communicating with the upper story through the floor thereof and a second suction port and a second ejection port both communicating with the lower story through the ceiling thereof;

a refrigeration cycle system provided with a condensation heat exchanger and an evaporation heat exchanger which are arranged in the housing;

a first blower, which is built near the condensation heat exchanger in the housing, for conducting the air of the upper story into the housing through the first suction port, and discharging the air into the upper story through the condensation heat exchanger and the first ejection port;

a second blower, which is arranged near the evaporation heat exchanger in the housing, for conducting the air of the lower story into the housing through the second suction port, and discharging the air passing through the evaporation heat exchanger into the lower story through the second ejection port; and valve means arranged in the first suction and ejection ports and second suction and ejection ports to selectively open the ports.

2. The air conditioner according to claim 1, wherein said housing has partitioning means dividing its interior into a heating chamber in which the condensation heat exchanger is installed, and a cooling chamber in which the evaporation heat exchanger is built, the first suction port and ejection port are open to the heating chamber, and the second suction port and ejection port are open to the cooling chamber.

3. The air conditioner according to claim 2, wherein said condensation heat exchanger is set to divide the heating chamber into an upstream heating region and a downstream heating region, the first suction port is open to the upstream heating region, the first ejection port is open to the downstream heating region, the evaporation heat exchanger is positioned to divide the cooling chamber into an upstream cooling region and a downstream cooling region, the second suction port is open to the upstream cooling region, the second ejection port is open to the downstream cooling region, the first blower is built in the upstream heating region, and the second blower is installed in the upstream cooling region.

4. The air conditioner according to claim 3, wherein said housing has an open air introducing passage defined by the partitioning means and communicating with the open air, the partitioning means is provided with a first inlet port for effecting communication between the open air introducing passage and upstream heating region, open air being conducted into the upstream heating region through the first inlet port, and also with a second inlet port for effecting communication between the open air introducing passage and upstream cooling region, open air being carried into the upstream cooling region through the second inlet port, and the valve means includes valves fitted to the first and second inlet ports to selectively open the ports.

5. The air conditioner according to claim 4, wherein said housing is provided with a first exhaust port which is open to the downstream heating region and communicates with the open air, the air of the downstream heating region being drawn outdoors through the first exhaust port, and with a second exhaust port which is open to the downstream cooling region and communicates with the open air, the air of the downstream cooling region is drawn outdoors through the second exhaust port.

6. The air conditioner according to claim 5, wherein said housing includes a first ventilation port which is open to the upstream heating region and communicates with the lower story through the ceiling, thereby allowing the air of the lower story to flow into the upstream heating region, and a second ventilation port which is open to the upstream cooling region and communicates with the upper story through the floor, thereby allowing the air of the upper story to flow into the upstream cooling region, and the valve means includes valves for selectively opening the first and second ventilation ports.

7. The air conditioner according to claim 6, wherein said partitioning means is provided with a first ventilation inlet port for effecting communication between the open air introducing passage and upstream heating region and a second ventilation inlet port for effecting communication between the open air introducing passage and upstream cooling region, and the valve means includes valves for selectively opening the first and second ventilation inlet ports.

8. A combination comprising:

a building having a plurality of stories, each of which has a floor and a ceiling spaced from the floor of a next upper story, the floor being provided with first and second penetrating heating ventilation openings, and the ceiling being provided with first and second penetrating cooling ventilation openings; and an air conditioner which comprises:

a housing built in the space defined between the ceiling of a first lower story and the floor of a second upper story above said first story, the housing being provided with a first suction port communicating with the upper story through the first heating ventilation opening, a first ejection port communicating with the upper story through the second heating ventilation opening a second suction port communicating with the lower story through the first cooling ventilation opening, and a second ejection port communicating with the lower story through the second cooling ventilation opening;

a refrigeration cycle system provided with a condensation heat exchanger and an evaporation heat exchanger which are built in the housing;

a first blower, which is built near the condensation heat exchanger in the housing, for conducting the air of the upper story into the housing through the first suction port, and drawing off the air passing through the condensation heat exchanger into the upper story through the first ejection port;

a second blower, installed near said evaporation heat exchanger in the housing, for conducting the air of the lower story into the housing through the second suction port, and drawing off the air passing through the evaporation heat exchanger into the lower story through the second ejection port; and valve means fitted the the first suction and ejection ports and second suction and ejection ports to selectively open the ports.

* * * * *